US010273719B1

(12) United States Patent
Timothy

(10) Patent No.: US 10,273,719 B1
(45) Date of Patent: Apr. 30, 2019

(54) GATE LATCH ASSEMBLY

(71) Applicant: E. Erik Timothy, Apollo Beach, FL (US)

(72) Inventor: E. Erik Timothy, Apollo Beach, FL (US)

(73) Assignee: Nationwide Industries, hc., Tampa, FL (US)

( * ) Notice: Subject to any disclaimer, the term of this patent is extended or adjusted under 35 U.S.C. 154(b) by 364 days.

(21) Appl. No.: 15/330,630

(22) Filed: Oct. 19, 2016

(51) Int. Cl.
*E05B 65/00* (2006.01)
*E05B 67/38* (2006.01)
*E05B 17/20* (2006.01)
*E05C 3/02* (2006.01)

(52) U.S. Cl.
CPC ..... *E05B 65/0007* (2013.01); *E05B 17/2007* (2013.01); *E05B 67/383* (2013.01); *E05C 3/02* (2013.01); *E05B 2067/386* (2013.01)

(58) Field of Classification Search
CPC ..... Y10T 292/1043; Y10T 292/1044; Y10T 292/1049; Y10T 292/1083; Y10T 292/1086; Y10T 292/31; Y10T 292/314; Y10T 292/323; Y10T 292/68; Y10T 292/683; Y10T 292/696; Y10T 292/702; Y10T 70/40; Y10T 70/409; Y10T 70/5735; Y10T 70/5739; Y10T 70/5774; Y10T 70/577; Y10S 70/63; Y10S 292/29; E05B 65/0007; E05B 67/383; E05B 2067/386; E05B 17/20; E05B 17/2007; E05B 17/2023; E05C 3/012; E05C 3/04; E05C 3/044
See application file for complete search history.

(56) References Cited

U.S. PATENT DOCUMENTS 3,926,018 A * 12/1975 Joersz ..... E05B 65/0007 292/258
3,988,031 A * 10/1976 Meyer ..... E05B 67/383 292/153
4,697,443 A * 10/1987 Hillin ..... E05B 65/0007 292/205
4,997,219 A * 3/1991 Carter ..... E05B 67/383 292/148

(Continued)

*Primary Examiner* — Alyson M Merlino

(57) ABSTRACT

A gate latch assembly selectively operable in a locked configuration and an unlocked configuration to secure a gate in a closed position to block or obstruct a portal in a fence or wall allowing any one of a plurality of users to independently unlock the gate latch assembly and open the gate having a latch frame including a gate latch pivotally coupled to the upper portion thereof movable between first or closed position and a second or open position, a lock tab support formed on the lower portion thereof to support a plurality of lock tabs corresponding to the plurality of users each selectively and independently vertically slideable on the latch frame and horizontally removable from the latch frame such that when the entire plurality of lock tabs is mounted on the latch frame the proximal portion of the gate latch engages the upper most lock tab to prevent movement of the gate latch from the closed position to the open position and when at least one of the plurality of lock tabs is removed from the latch frame a clearance is created between the proximal end of the gate latch and the upper most lock tab allowing the gate latch to be pivoted from the closed position to the open position to permit the gate to be opened.

26 Claims, 8 Drawing Sheets

(56) References Cited

U.S. PATENT DOCUMENTS

| | | | | |
|---|---|---|---|---|
| 5,868,015 | A * | 2/1999 | Eaker | E05B 67/383 292/148 |
| 6,557,384 | B1 * | 5/2003 | Cuesta | E05B 67/22 70/14 |
| 7,757,523 | B1 * | 7/2010 | Garcia | E05B 65/0007 292/148 |
| 9,273,490 | B1 * | 3/2016 | McNeil | E05B 67/383 |
| 9,702,169 | B2 * | 7/2017 | McNeil | E05B 67/383 |
| 2004/0226322 | A1 * | 11/2004 | McNeil | E05B 67/383 70/2 |
| 2008/0041123 | A1 * | 2/2008 | McKee | E05B 67/383 70/20 |
| 2008/0264116 | A1 * | 10/2008 | McNeil | E05B 67/383 70/20 |

* cited by examiner

GATE LATCH ASSEMBLY

BACKGROUND OF THE INVENTION

Field of the Invention

A gate latch assembly to secure a gate in a locked position to block or obstruct a portal in a fence or wall while allowing anyone of a plurality of users to independently unlock the gate latch assembly and open the gate.

Description of the Prior Art

Numerous gate latches and locking systems have been designed and used to limit or prevent access to an area defined by a fence, wall or similar structure.

Commonly with chain link fences, a swinging or rolling gate is employed to block or secure the portal or opening in the fence.

Often a fork-like gate latch is used to retain the gate in the closed position. A padlock may be used to lock a fork-like gate latch in place to prevent unauthorized entry through the portal into the area surrounded by the fence or wall.

Unfortunately, where random access to the area is necessary by numerous users such as a construction site, the use of a single padlock requires multiple keys without accountability. Thus, a need exists for a mechanical locking gate locking system configured to allow individual users random access using different padlocks or similar locking devices.

SUMMARY OF THE INVENTION

The present invention relates to a gate latch assembly to secure a gate in a locked position to block or obstruct a portal in a fence or wall allowing anyone of a number of users to independently unlock the gate latch assembly and open the gate. In particular, the gate latch assembly is selectively operable in a closed and locked position The gate assembly comprises a latch frame having a gate latch pivotally coupled to the upper portion thereof and a lock tab support formed on the lower portion thereof to support a plurality of lock tabs on the latch frame.

The latch frame comprises a pair of frame members held in fixed spaced relationship relative to each other by an interconnecting cross-member extending between the upper portion of each frame member.

The gate latch comprises a pair of gate latch members held in fixed spaced relationship relative to each other by a gate latch cross-member. Each gate latch member comprises a proximal mounting plate or member including a pivot hole formed therethrough, and a corresponding proximal mounting plate or member to selectively engage the fence or wall to limit horizontal movement of the gate when the gate latch is in the closed position.

The gate latch is pivotally coupled to the latch frame by a pivot rod extending through each pivot hole formed on each proximal mounting plate or member and a hollow coupling sleeve affixed to the interconnecting cross-member.

Each lock tab comprises a pair of substantially parallel interconnected spaced apart lock tab members or plates to cooperatively form a frame member receiving channel therebetween wide enough to operatively place each lock tabs on one of the two frame member. An aperture is formed on the free end portion of each substantially parallel interconnecting spaced apart lock tab member or plate of each lock tab member. Corresponding apertures of each lock tab are aligned relative to each other. The distance between the inner end of the frame member receiving channel and the corresponding apertures is greater than the width of the latch frame member upon which the lock tabs are mounted such that a padlock can be operatively locked on a corresponding lock tab to secure each lock tab in place on the latch frame member of the latch frame.

When the gate latch assembly is in the closed and locked configuration, the aggregate height of the lock tabs supported on the lock tab support holds or supports the upper most lock tab adjacent the proximal portion of the gate latch such that pivoting of the gate latch upward is limited to stop rotation of the gate latch to the open position.

When any one of the padlocks is unlocked, and removed from the corresponding aperture, the lock tab can be removed from the frame member of the latch frame, creating a gap or space between the proximal end of the gate latch and the upper most lock tab allowing the gate latch to pivot upward to clear the distal end of the gate latch from the fence or wall to swing open.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
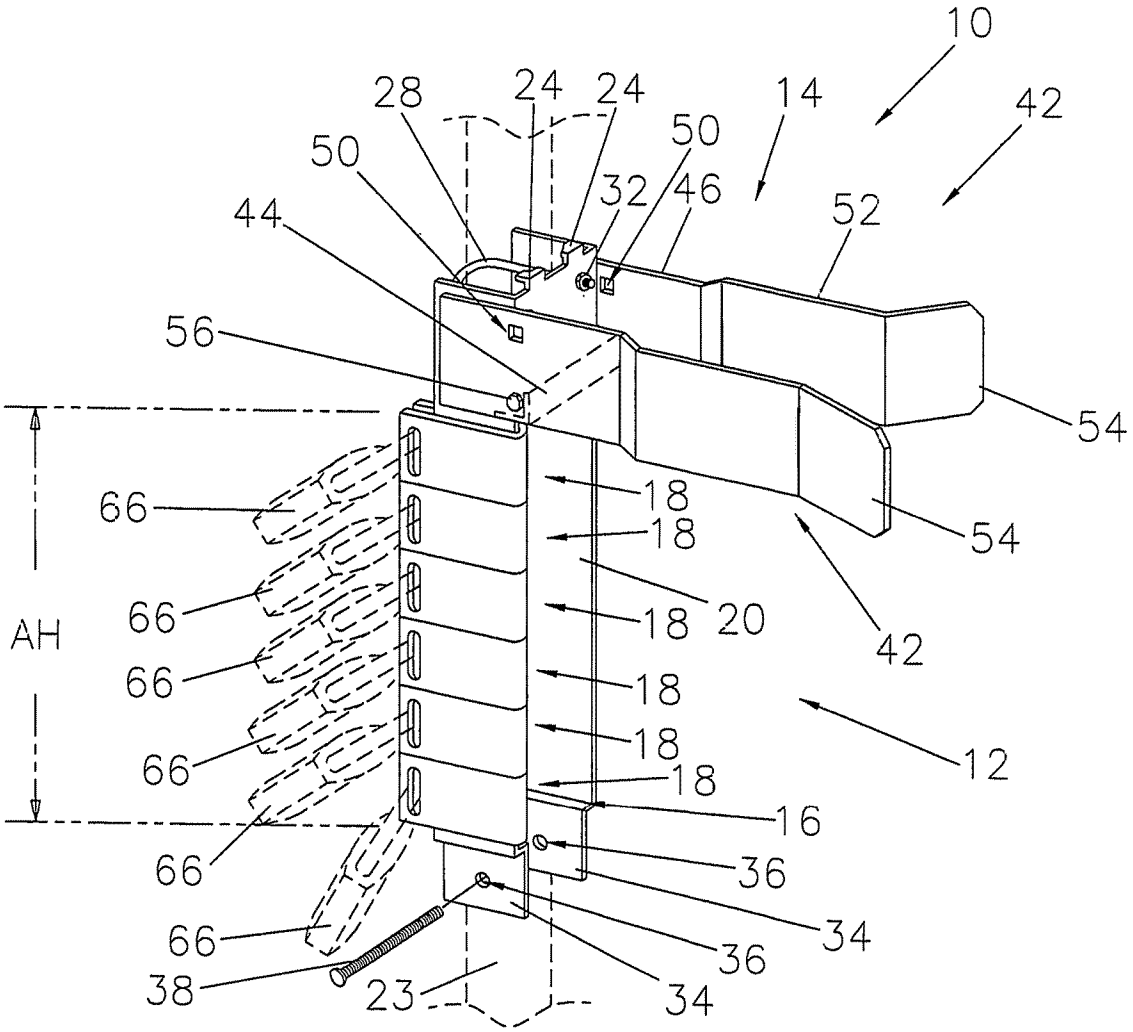
FIG. 1 is a perspective view of gate latch assembly of the present invention in the closed and locked configuration.
Figure 2:
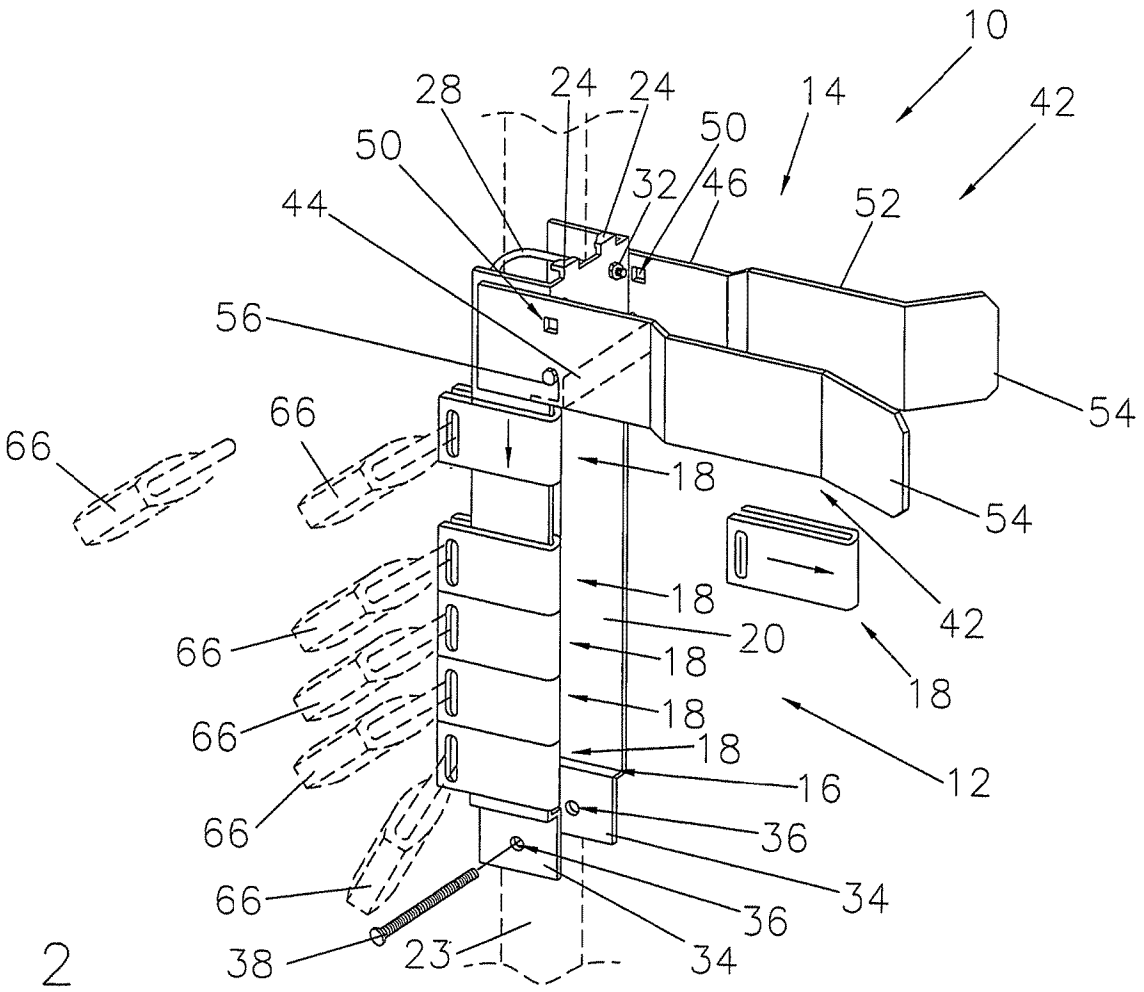
FIG. 2 is a perspective view of the gate latch assembly of the present invention in the unlocked and open configuration with a lock tab removed from latch frame.
Figure 2A:
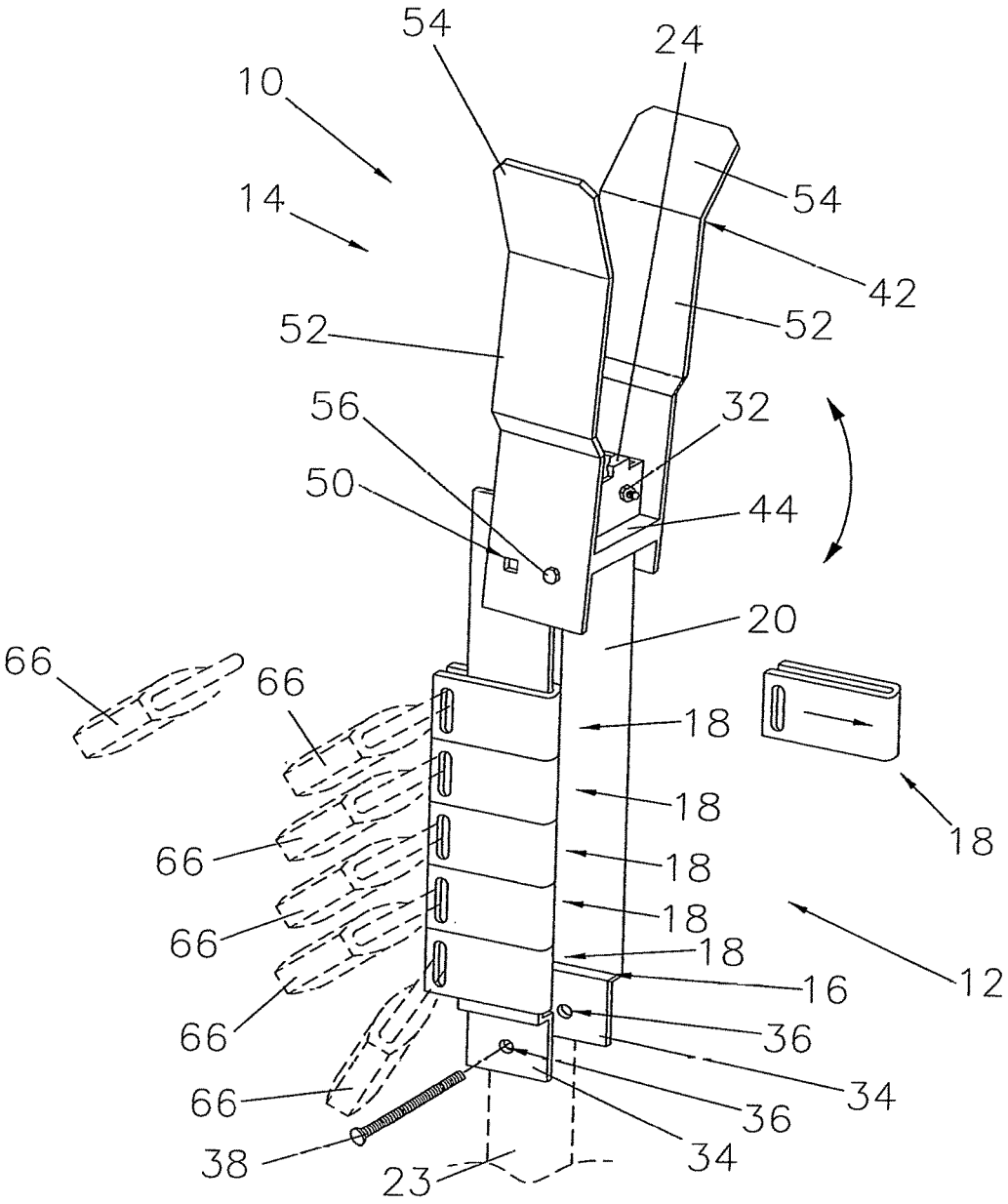
FIG. 2A is a partial perspective view of the gate latch assembly of the present invention in the unlocked configuration with a lock tab removed from the latch frame.
Figure 3:
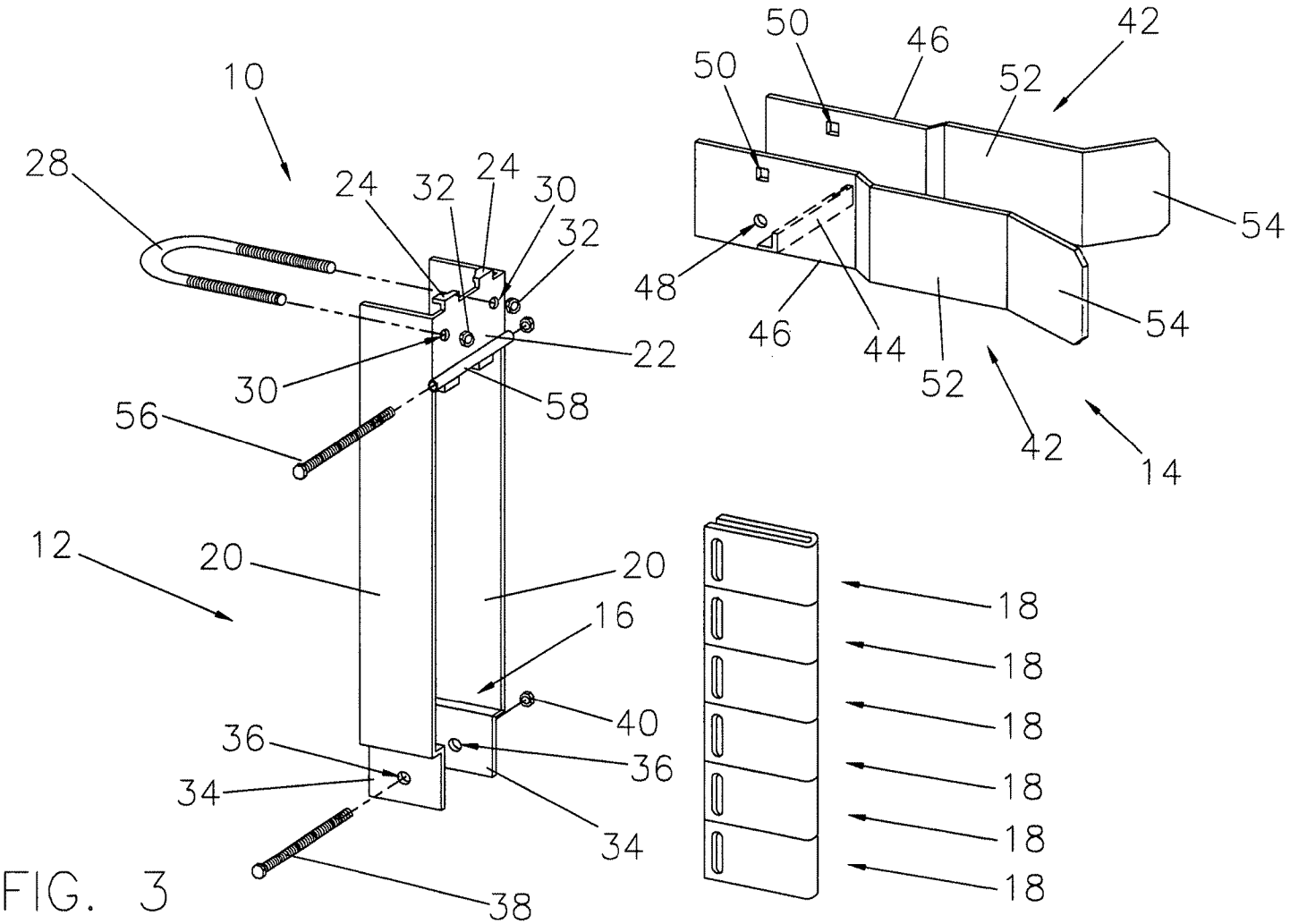
FIG. 3 is an exploded view of the gate latch assembly of the present invention.

As shown in FIGS. 1 through 3, the present invention relates to a gate latch assembly generally indicated as 10 to secure a gate (not shown) in a locked position to block or obstruct a portal in a fence or wall (not shown) allowing anyone of a number of users to independently unlock the gate latch assembly 10 and open the gate (not shown). In particular, the gate latch assembly 10 is selectively operable in a closed and locked position (FIG. 1) and an unlocked and open position (FIG. 2A).

The gate latch assembly 10 comprises a latch frame generally indicated as 12 having a gate latch generally indicated as 14 pivotally coupled to the upper portion thereof and a lock tab support generally indicated as 16 (FIGS. 4 and 5) formed on the lower portion thereof to support a plurality of lock tabs each generally indicated as 18 on the latch frame 12.

Figure 5:
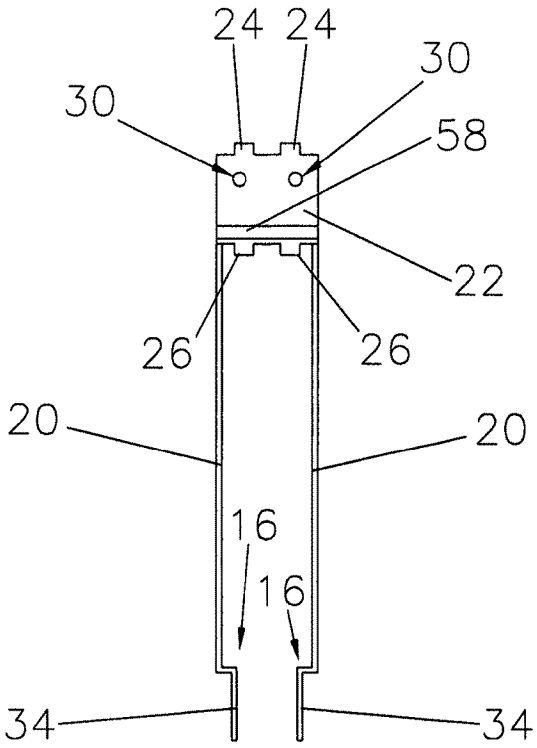
FIG. 5 is a front view of the latch frame of the present invention.
Figure 4:
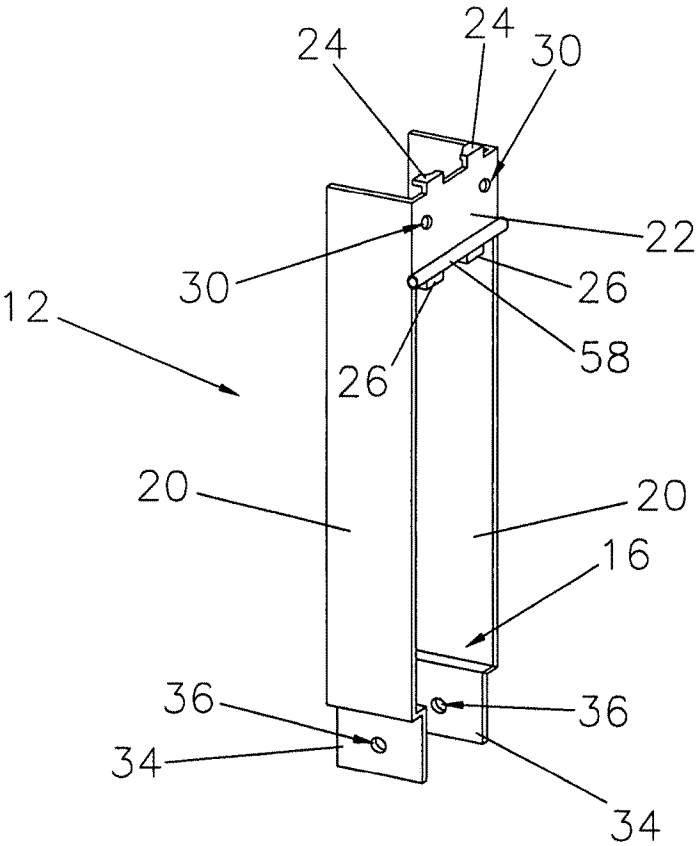
FIG. 4 is a perspective view of the latch frame of the present invention.
Figure 7:
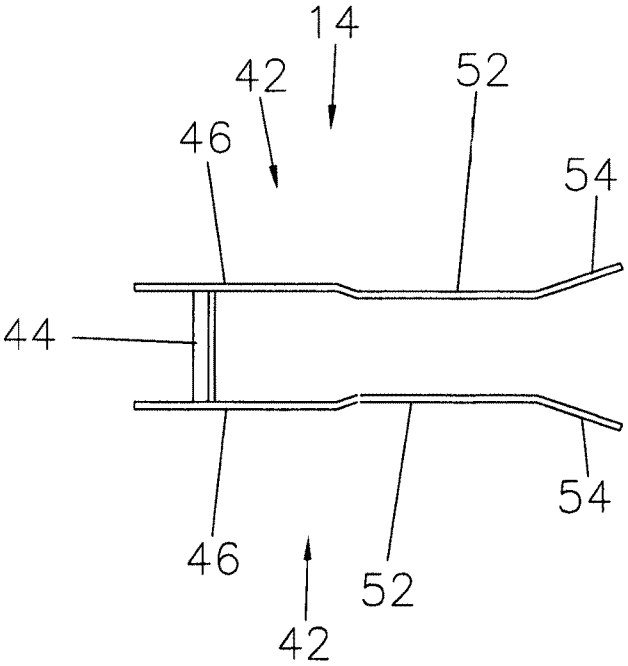
FIG. 7 is a top view of the latch arm of the present invention.
Figure 6:
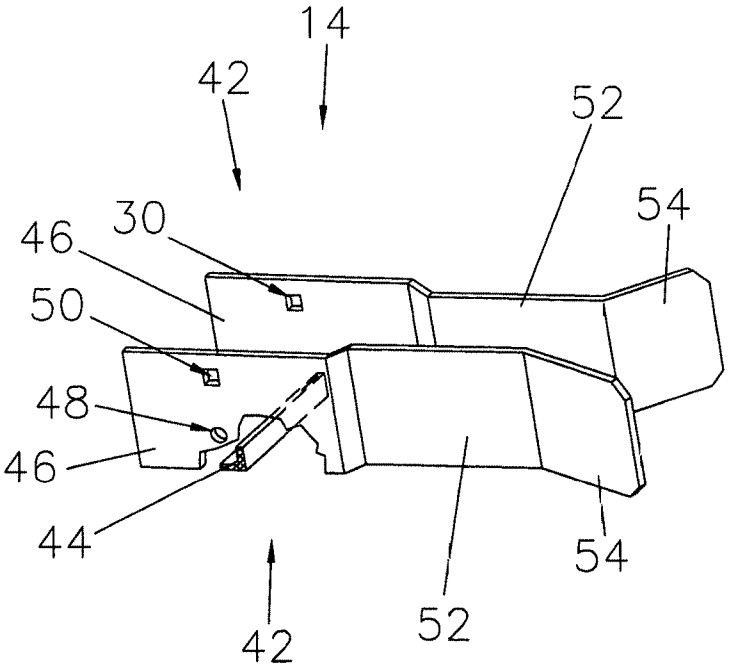
FIG. 6 is a perspective view of the latch arm of the present invention.

As best shown in FIGS. 3 through 5, the latch frame 12 comprises a pair of substantially flat, substantially parallel frame members each indicated as 20 held in fixed spaced relationship relative to each other by an interconnecting cross-member 22 extending between the upper portion of each substantially flat frame member 20. The lock tab support 16 may be formed on either or both the substantially flat frame members 20.

The latch frame 12 is secured to a gate post 23 by an upper mount and lower mount. In particular as shown in FIGS. 1 through 5, the upper mount comprises a pair of upper serrated tabs each indicated as 24 extending inwardly from the upper portion of the interconnecting cross-member 22 and a pair of lower serrated tabs each indicated as 26 extending inwardly from the lower portion of the interconnecting cross-member 22 below the upper serrated tabs 24 to engage the outer face of the free end or post 23 of the gate (not shown) in combination with a U-bolt 28 extending through a pair of holes each indicated as 30 formed through the interconnecting cross-member 22 and held in place against the inner face of the free end or post 23 of the gate (not shown) by a pair of nuts or fasteners each indicated as 32. The lower mount comprises a mounting tab 34 extending downwardly from the inner or free end of each lock tab support 16 and substantially parallel to the corresponding substantially flat frame member 20. A hole 36 is formed through each mounting tab 34 to receive a carriage bolt 38 held in place against each side face of the free end or post 23 of the gate (not shown) by a nut or fastener 40.

Although the substantially flat, substantially parallel members 20 of the latch frame 12 are depicted as substantially vertical; the substantially flat, substantially parallel members 20 of the latch frame 12 may be disposed in a substantially horizontal direction or on a diagonal direction relative to either a vertical or horizontal plain.

As best shown in FIGS. 1 through 3, 6 and 7, the gate latch 14 comprises a pair of gate latch members each generally indicated as 42 held in fixed spaced relationship relative to each other by a gate latch cross-member 44. Each gate latch member 42 comprises a substantially flat proximal mounting plate or member 46 including a lower pivot hole 48 and an upper padlock receiving hole 50 formed therethrough, a substantially flat intermediate arm 52 off-set inwardly relative to the corresponding substantially flat proximal mounting plate or member 46 to selectively engage the fence or wall to limit horizontal movement of the gate (not shown) when the gate latch 14 is in the closed position and a substantially flat distal guide plate 54 angled outwardly from the distal end portion of the corresponding substantially flat intermediate arm 52 to guide the gate latch 14 from the open position to the closed position relative to the fence or wall (not shown) when the gate is closed (not shown).

The gate latch 14 is pivotally coupled to the latch frame 12 by a pivot rod 56 extending through each lower pivot hole 48 formed on each substantially flat proximal mounting plate or member 46 and a hollow coupling sleeve 58 affixed to the outer surface of the interconnecting cross-member 22. A nut or fastener 60 secures the gate latch 14 to the latch frame 12 to limit horizontal movement therebetween.

Figure 9:
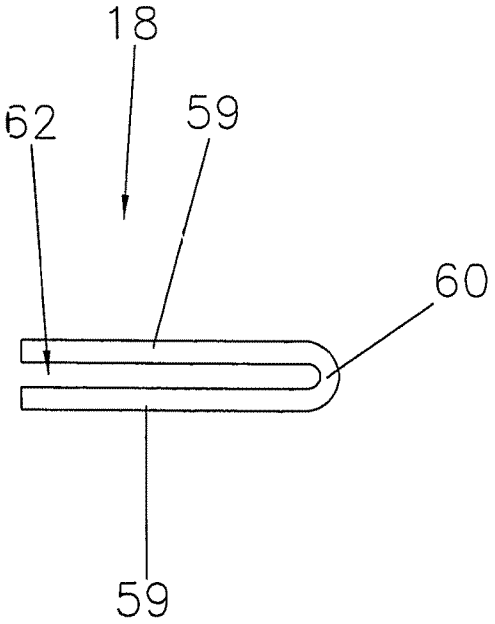
FIG. 9 is a top view of a lock tab of the present invention.
Figure 8:
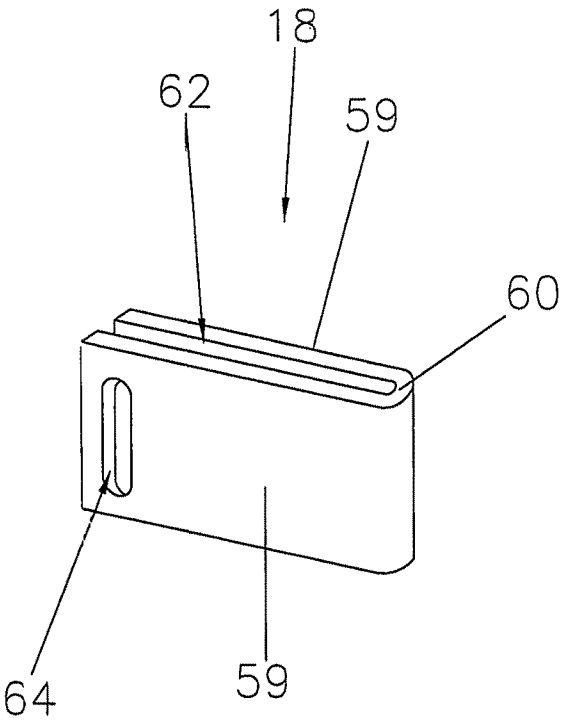
FIG. 8 is a perspective view of a lock tab of the present invention.

As best shown in FIGS. 8 and 9, each lock tab 18 comprises a pair of substantially flat, substantially parallel lock tab members or plates each indicated as 59 and an arcuate member or interconnecting end portion 60 to cooperatively form a frame member receiving channel 62 therebetween wide enough to operatively place each lock tabs 18 on the same substantially flat frame member 20. Specifically, the frame member receiving channel 62 is wider than the thickness of either substantially flat frame member 20. A substantially vertically disposed slot or oblong aperture 64 is formed on the free end portion of each lock tab member or plate 59 and aligned to relative to each other on each respective lock tab 18. The distance between the inner end of the frame member receiving channel 62 and the corresponding substantially vertically disposed slots or oblong apertures 64 is greater than the width of the latch frame member 20 on which the lock tabs 18 are mounted such that when a padlock 66 is operatively locked in a corresponding lock tab 18 to secure each lock tab 18 in place on the latch frame member 20 of the latch frame 12.

When the gate latch assembly 10 is in the closed and locked configuration (FIG. 1), the aggregate height (AH) of the lock tabs 18 supported on the lock tab support 16 positions the upper most lock tab 18 adjacent to the proximal portion of the gate latch 14 to engage the gate latch 14 when rotated or pivoted upward to limit or stop rotation of the gate latch 14 to the open position (FIG. 2A).

When one of the lock tabs 18 is unlocked, padlock 66 unlocked, and removed from the corresponding substantially vertically disposed or oblong aperture 64, the lock tab 18 can be removed from the substantially flat frame member 20 of the latch frame 12. Once the lock tab 18 is removed from the substantially flat frame member 20 of the latch frame a gap or space is created between the proximal end of the gate latch 14 and the upper most lock tab 18 allowing the gate latch 14 to pivot upward to clear the distal end of the gate latch 14 from the fence or wall (not shown) to swing open (FIG. 2A)

Figure 10:
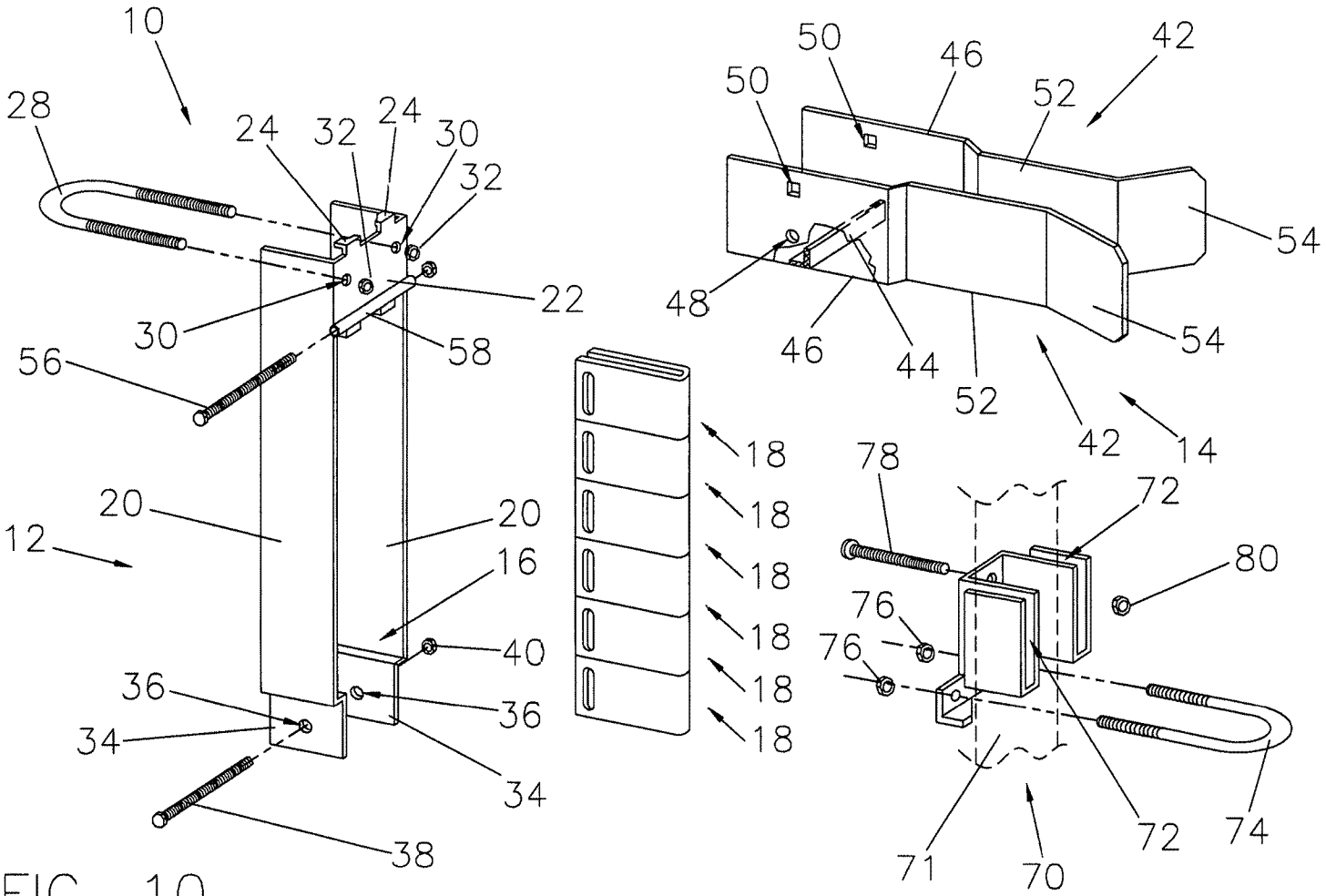
FIG. 10 is a perspective view of a double drive gate latch assembly of the present invention.

FIG. 10 depicts a double drive gate latch assembly generally indicated as 10 that further comprises a keeper generally indicated as 70. Otherwise, similar structural elements are similarly designated.

In particular, each substantially flat intermediate arm 52 rests in a corresponding channel 72 formed on opposite sides of the keeper 70 that is secured to the gate 71 by u-bolt 74 and fasteners or nuts 76, and bolt 78 and a nut fastener 80 combination opposite the gate post 23 on which the gate latch assembly 10 is secured.

The keeper 70 used for "double drive" applications where two gates are used that meet in the middle of a gate opening or portal. The keeper 70 performs two functions. First, the gate frame is effectively widened. The second feature is that the keeper 70 retains or secures the two gates together. Ordinarily the gates tend to open as the two adjoining gate frame portions would separate when the gates are swung or pivoted. Since the arms are generally straight and have some tolerance, there is nothing to prevent the non-latch gate (not shown) from slipping out of the gate latches. The keeper 70 function is to retain or hold the gates (not shown) together. Furthermore, the substantially flat distal guide plates 54 disengage from the keeper 70 extending different as the keeper 70 has retaining elements on either side of each of the gate latch members 42 when the gate latch 14 is in the latched position.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A gate latch assembly selectively operable in a locked configuration to secure a gate in a closed position to block or obstruct a portal in a fence or wall allowing any one of a plurality of users to independently place the gate latch assembly in an unlocked configuration and open the gate, said gate latch assembly comprising a latch frame including a gate latch pivotally coupled to an upper portion of said latch frame and pivotable between a closed position and an open position, a lock tab support formed on a lower portion of said latch frame to support a plurality of lock tabs corresponding to the plurality of users, each lock tab is selectively and independently vertically slideable on said latch frame and horizontally removable from said latch frame such that when said plurality of said lock tabs is mounted on said latch frame, a proximal portion of said gate latch engages an upper most one of said plurality of lock tabs to prevent pivoting of said gate latch from said closed position to said open position and when at least one of said plurality of lock tabs is removed from said latch frame, a clearance is created between said proximal end of said gate latch and the upper most one of said plurality of lock tabs, allowing said gate latch to be pivoted from said closed position to said open position to permit the gate to be opened.

2. The gate latch assembly of claim 1 wherein said latch frame comprises a pair of frame members held in a fixed spaced relationship relative to each other by an interconnecting cross-member extending between said frame members.

3. The gate latch assembly of claim 2 wherein a said lock tab support is formed on one or both said frame members.

4. The gate latch assembly of claim 1 wherein said gate latch comprises a pair of gate latch members held in a fixed spaced relationship relative to each other by a gate latch cross-member.

5. The gate latch assembly of claim 4 wherein each gate latch member comprises a proximal mounting plate or member.

6. The gate latch assembly of claim 5 wherein each said gate latch member further comprises an intermediate arm off-set inwardly relative to a corresponding proximal mounting plate or member to selectively engage the fence or wall to limit horizontal movement of the gate when said gate latch is in said closed position.

7. The gate latch assembly of claim 6 wherein each said gate latch member further comprises a distal guide plate angled outwardly from a distal end portion of a corresponding one of said intermediate arms to guide said gate latch from said open position to said closed position relative to the fence or wall when the gate is in the closed position.

8. The gate latch assembly of claim 5 wherein said gate latch is pivotally coupled to said latch frame by a pivot rod extending through a pivot hole formed in each said proximal mounting plates and a hollow coupling sleeve affixed to an outer surface of said interconnecting cross-member.

9. The gate latch assembly of claim 5 wherein said gate latch is pivotally coupled to said latch frame by a pivot rod extending through a pivot hole formed in each said proximal mounting plates.

10. The gate latch assembly of claim 2 wherein each lock tab comprises a pair of lock tab members or plates disposed in a spaced relationship relative to each other to cooperatively form a frame member receiving channel therebetween to selectively receive a portion of a corresponding one of said frame members.

11. The gate latch assembly of claim 10 wherein an aperture is formed in each lock tab member or plate such that the apertures are aligned relative to each other to selectively receive a corresponding padlock to secure each lock tab to said corresponding one of said frame members.

12. The gate latch assembly of claim 11 wherein a distance between an inner end of said frame member receiving channel and said apertures is greater than a width of said corresponding one of said frame members on which said lock tabs are mounted such that the corresponding padlock secures each corresponding lock tab in place on said corresponding one of said frame members of said latch frame.

13. The gate latch assembly of claim 10 wherein a substantially vertically disposed slot or oblong aperture is formed in each said lock tab member or plate such that the substantially vertically disposed slots or oblong apertures are aligned relative to each other to selectively receive a corresponding padlock to secure each lock tab to said corresponding one of said frame members.

14. The gate latch assembly of claim 13 wherein a distance between an inner end of said frame member receiving channel and said corresponding substantially vertically disposed slots or oblong apertures is greater than a width of said corresponding one of said frame members on which said lock tabs are mounted such that the corresponding padlock secures each lock tab in place on the corresponding one of said frame members of said latch frame.

15. A gate latch assembly selectively operable in a locked configuration to secure a gate in a closed position to block or obstruct a portal in a fence or wall allowing any one of a plurality of users to independently place the gate latch assembly in an unlocked configuration and open the gate, said gate latch assembly comprising a latch frame including a gate latch pivotally coupled to the upper portion of said latch frame and pivotable between a closed position and an open position, said gate latch comprising a pair of gate latch members held in a fixed spaced relationship relative to each other by a gate latch cross-member, a lock tab support formed on a lower portion of said latch frame to support a plurality of lock tabs corresponding to the plurality of users, each said lock tab is selectively and independently vertically slidable on said latch frame and horizontally removable from said latch frame such that when said plurality of said lock tabs is mounted on said latch frame, a proximal portion of said gate latch engages an upper most one of said plurality of lock tabs to prevent pivoting of said gate latch from said closed position to said open position, and when at least one of said plurality of lock tabs is removed from said latch frame a clearance is created between said proximal end of said gate latch and the upper most one of said plurality of lock tabs, allowing said gate latch to be pivoted from said closed position to said open position to permit the gate to be opened, said latch frame comprising a pair of frame members held in fixed spaced relationship relative to each other by an interconnecting cross-member extending between said frame members, said gate latch pivotally coupled to said latch frame by a pivot rod extending through a pivot hole formed in each of said proximal mounting plates, each lock tab comprising a pair of lock tab members or plates disposed in spaced relationship relative to each other to cooperatively form a frame member receiving channel therebetween to selectively receive a portion of a corresponding one of said frame members and an aperture formed in each lock tab member or plate such that said apertures are aligned relative to each other to selectively receive a corresponding padlock to secure each lock tab to said corresponding one of said frame members.

16. The gate latch assembly of claim 15 wherein each gate latch member further comprises a proximal mounting plate or member, an intermediate arm off-set inwardly relative to a corresponding one of said proximal mounting plates or members to selectively engage the fence or wall to limit horizontal movement of the gate when said gate latch is in said closed position and a distal guide plate angled outwardly from a distal end portion of a corresponding one of said intermediate arms to guide said gate latch from said open position to said closed position relative to the fence or wall when the gate is in the closed position.

17. The gate latch assembly of claim 16 wherein a distance between an inner end of said frame member receiving channel and said apertures is greater than a width of said corresponding one of said frame members on which said lock tabs are mounted such that the corresponding padlock secures each lock tab in place on said corresponding one of said frame members of said latch frame.

18. The gate latch assembly of claim 16 wherein the apertures formed in the lock tab members are substantially vertically disposed slots or oblong apertures.

19. The gate latch assembly of claim 15 wherein a distance between an inner end of said frame member receiving channel and said apertures is greater than a width of said corresponding one of said frame members on which said lock tabs are mounted such that the corresponding padlock secures each lock tab in place on said corresponding one of said frame members of said latch frame.

20. The gate latch assembly of claim 15 wherein the apertures formed in the lock tab members are substantially vertically disposed slots or oblong apertures.

21. The gate latch of claim 15 wherein at least one of said gate latch members includes a padlock receiving hole formed therethrough to selectively receive a padlock to secure said gate latch assembly in said locked configuration independent of said plurality of lock tabs and corresponding padlocks.

22. The gate latch of claim 2 wherein at least one of a plurality of gate latch members of said gate latch includes a padlock receiving hole formed therethrough to selectively receive a padlock to secure said gate latch assembly in said locked position independent of said plurality of lock tabs.

23. A gate latch assembly selectively operable in a locked configuration to secure a gate in a closed position to block or obstruct a portal in a fence or wall allowing any one of a plurality of users to independently place the gate latch assembly in an unlocked configuration and open the gate, said gate latch assembly comprising a latch frame including a gate latch pivotally coupled to said latch frame and pivotable between a closed position and an open position, a lock tab support formed on said latch frame to support a plurality of lock tabs corresponding to the plurality of users, each lock tab is selectively and independently slidable on said latch frame and removable from said latch frame such that when said plurality of lock tabs is mounted on said latch frame, a proximal portion of said gate latch engages one of said plurality of lock tabs located nearest the gate latch to prevent pivoting of said gate latch from said closed position to said open position, and when at least one of said plurality of lock tabs is removed from said latch frame, a clearance is created between said proximal end of said gate latch and said one of said plurality of lock tabs located nearest said gate latch, allowing said gate latch to be pivoted from said closed position to said open position to permit the gate to be opened, said latch frame comprising a pair of frame members held in fixed spaced relationship relative to each other by an interconnecting cross-member extending between said frame members, gate latch comprises a pair of gate latch members held in fixed spaced relationship relative to each other by a gate cross-member, each latch member comprises a proximal mounting plate or member, said gate latch pivotally coupled to said latch frame by a pivot rod extending through a pivot hole formed on each said proximal mounting plates or members, each said lock tab comprising a pair of lock tab members or plates disposed in a spaced relationship relative to each other to cooperatively form a frame member receiving channel there between to selectively receive a portion of a corresponding one of said frame members and an aperture formed in each lock tab member or plate, said apertures are aligned relative to each other on each lock tab to selectively receive a corresponding padlock to secure each lock tab to said corresponding one of said frame members.

24. The gate latch assembly of claim 23 wherein each lock tab member comprises a latch arm, and said gate latch assembly further comprises a keeper mounted to an adjacent gate frame or an adjacent gate containing a pair of slots to engage said latch arms to maintain said gate latch assembly in said closed configuration to secure the gate in the closed position or to secure the gate and the adjacent gate together.

25. The gate latch assembly of claim 1 further including a keeper mounted to an adjacent gate frame or an adjacent gate containing at least one slot to engage at least one latch arm of said gate latch to maintain said gate latch assembly in said closed configuration to secure the gate in the closed position or to secure the gate and the adjacent gate together.

26. The gate latch assembly of claim 15 wherein each lock tab member comprises a latch arm, and said gate assembly further including comprises a keeper mounted on an adjacent gate frame or adjacent gate containing a pair of slots to engage said latch arms to maintain said gate latch assembly in said closed configuration to secure the gate in the closed position or to secure the gate and the adjacent gate frame together.

* * * * *